US005815844A

United States Patent [19]

Wowk

[11] Patent Number: 5,815,844

[45] Date of Patent: Oct. 6, 1998

[54] PIVOTING POCKET

[76] Inventor: Peter Wowk, 42 Vosburgh Rd., Mechanicville, N.Y. 12118

[21] Appl. No.: 910,773

[22] Filed: Aug. 13, 1997

[51] Int. Cl.[6] ..... A41D 27/20

[52] U.S. Cl. ..... 2/247; 2/254

[58] Field of Search ..... 2/247, 248, 250, 2/251, 254, 249, 252, 275, 94

[56] References Cited

U.S. PATENT DOCUMENTS

| | | | |
|---|---|---|---|
| 1,645,502 | 10/1927 | Sweet | 2/247 |
| 1,664,460 | 4/1928 | Mayer | 2/247 |
| 1,821,809 | 9/1931 | Johnson | 2/254 |
| 1,821,837 | 9/1931 | Johnson | 2/254 |
| 4,667,347 | 5/1987 | Greer | 2/254 |
| 5,072,456 | 12/1991 | Elin | 2/247 |
| 5,526,535 | 6/1996 | Dobrzenski | 2/247 |
| 5,708,978 | 1/1998 | Johnsrud | 2/94 |

FOREIGN PATENT DOCUMENTS

| | | | |
|---|---|---|---|
| 16682 | 7/1914 | United Kingdom | 2/247 |

*Primary Examiner*—Amy B. Vanatta
*Attorney, Agent, or Firm*—Jay R. Yablon

[57] ABSTRACT

A pivoting pocket utilizes a triple strength triangular stitching attachment to an article of clothing. The pocket is enabled to pivot about a horizontal stitch at the base of the triangle. Stitches along the other two sides of the triangle provide extra strength and facilitate easy attachment to the clothing. The pocket is self contained having both a front and a back.

8 Claims, 1 Drawing Sheet

PIVOTING POCKET

BACKGROUND OF THE INVENTION

Figure 1:
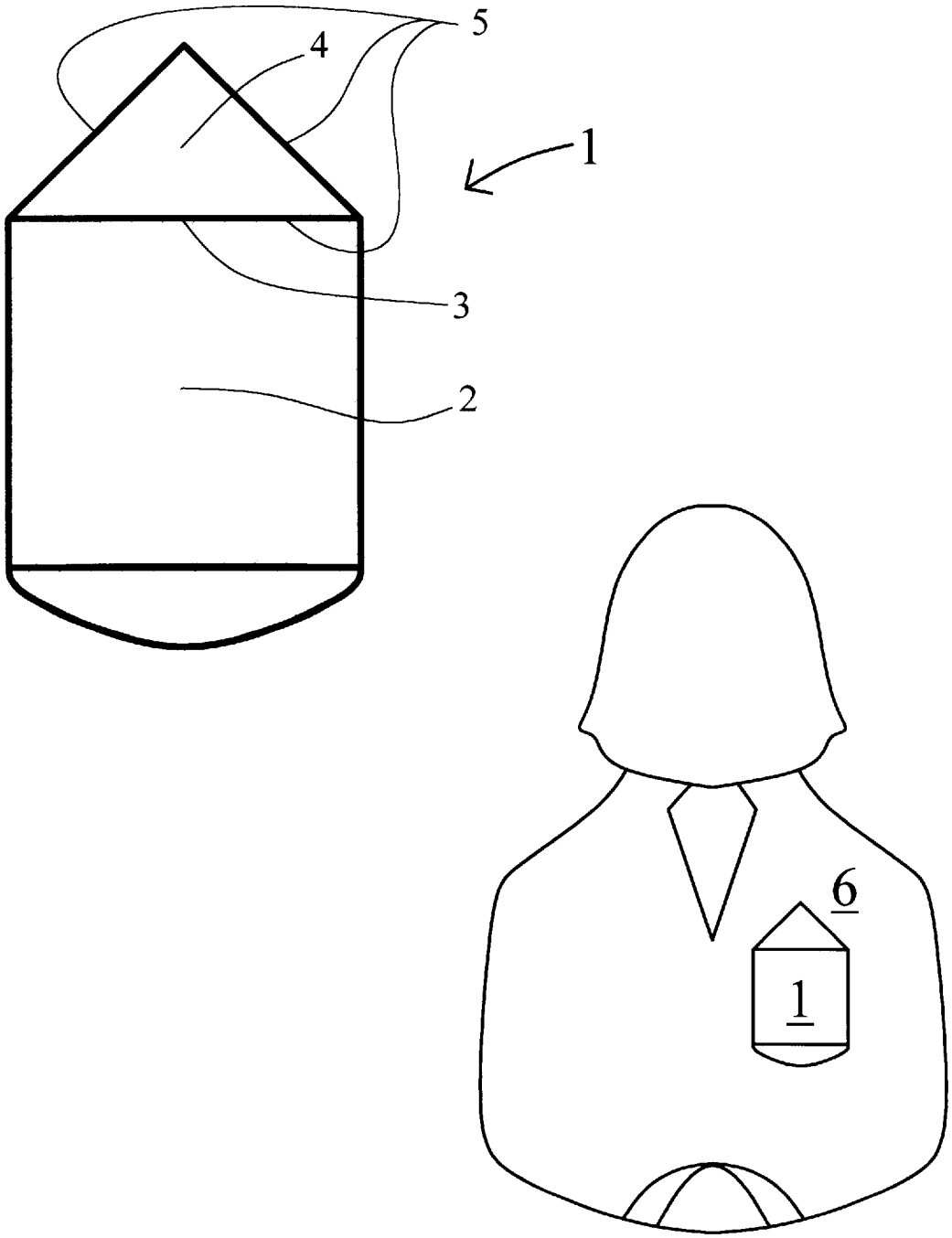

This Invention relates to clothing, specifically to a new pocket design.

BACKGROUND PRIOR ART

This Invention solves the problem of items being lost.

OBJECTS AND ADVANTAGES

Accordingly, Several advantages of my invention: This clothing will allow great security of its items to its wearer, Also this invention will prevent the loss of items placed within it making it a pleasant piece of apparel to be wearing.

DRAWING FIGURES

Figure one is a perspective exploded front view of my invention.

SUMMARY

The essence of my invention is to provide the consumer assurance of safe keeping of their possessions.

DESCRIPTION OF INVENTION

FIG. 1 shows a perspective view of the pivoting pocket 1 in accordance with the invention. Pocket member 2 (shaded) is self contained having both a front portion and a back portion, and has a pivoting feature enabling it to float freely from shirt 6. In particular, a horizontal stitch 3 along the base of triangular attachment means 4 affixed to the top of the back of pocket member 2 creates the pivoting point for pocket member 2. Triangular stitching 5 is used to attach pocket member 2 to shirt 6.

OPERATION

Triangular stitching 5 attaches pocket member 2 to shirt 6. This triangular stitching 5 adds triple strength attachment for security to shirt 6. Horizontal stitching 3 allows the entire pocket member 2 to be totally pivotal so that the pocket member 2 can be completely free moving of shirt 6. Pocket member 2 has both a front portion and a back portion. Its operation is completely unrestricted in movement. Because it is self contained with both a front and a back, it is able to move freely to a degree of pivot greater than the degree of bend by its wearer.

CONCLUSION

The pivoting pocket will provide great safety of items to its wearer. The unique design gives the pocket great maneuverability to keep items safe. This pocket design can be applied and used on any type of clothing worn. The clothing made can take on different colors and shades to accommodate the consumer.

I claim:

1. A pivoting pocket for an article of clothing, comprising:

a self-contained pocket member further comprising a front portion and a back portion; and triangular attachment means with a base and two remaining sides defined thereby, affixed along said base to a top of said back portion of said pocket member; wherein:

said triangular attachment means is stitched to said article of clothing along said base of said triangular attachment means; and said triangular attachment means is further stitched to said article of clothing along said two remaining sides of said triangular attachment means; and said pocket member is thereby enabled to pivot freely about said base of said triangular attachment means outside of said article of clothing; whereby said pocket member is securely and easily attached to said article of clothing.

2. The pivoting pocket of claim 1, wherein said pocket member is not attached to said article of clothing except by means of said stitching along said base and said two remaining sides of said triangular attachment means.

3. The pivoting pocket of claim 2, wherein said two remaining sides are stitched to said article of clothing above where said base is stitched to said article of clothing.

4. The pivoting pocket of claim 2, wherein said two remaining sides are stitched to said article of clothing along the entire lengths of said two remaining sides.

5. A method of attaching a pivoting pocket to an article of clothing, comprising the steps of:

providing a self-contained pocket member further comprising a front portion and a back portion;

affixing triangular attachment means with a base and two remaining sides defined thereby, along said base, to a top of said back portion of said pocket member;

stitching said triangular attachment means to said article of clothing along said base of said triangular attachment means;

further stitching said triangular attachment means to said article of clothing along said two remaining sides of said triangular attachment means; and thereby enabling said pocket member to pivot freely about said base of said triangular attachment means outside of said article of clothing; whereby said pocket member is securely and easily attached to said article of clothing.

6. The method of claim 5, comprising the further step of not attaching said pocket member to said article of clothing except by said stitching along said base and said two remaining sides of said triangular attachment means.

7. The method of claim 5, comprising the further step of stitching said two remaining sides to said article of clothing above where said base is stitched to said article of clothing.

8. The method of claim 5, comprising the further step of stitching said two remaining sides to said article of clothing along the entire lengths of said two remaining sides.

* * * * *